US008322793B2

(12) United States Patent
Chen

(10) Patent No.: US 8,322,793 B2
(45) Date of Patent: Dec. 4, 2012

(54) SOFA KIT

(76) Inventor: Lionel T. Chen, Rowland Heights, CA (US)

( * ) Notice: Subject to any disclaimer, the term of this patent is extended or adjusted under 35 U.S.C. 154(b) by 172 days.

(21) Appl. No.: 12/383,905

(22) Filed: Mar. 30, 2009

(65) Prior Publication Data

US 2010/0244536 A1 Sep. 30, 2010

(51) Int. Cl.
*A47C 7/00* (2006.01)

(52) U.S. Cl. ..... 297/440.15; 297/440.14; 297/440.1

(58) Field of Classification Search ..... 297/440.1, 297/440.14, 440.15, 440.16, 463.1
See application file for complete search history.

(56) References Cited

U.S. PATENT DOCUMENTS 2,466,204 A * 4/1949 Brown ..... 297/115
2,660,228 A * 11/1953 Reinhold ..... 297/440.1
2,703,136 A * 3/1955 Masse ..... 297/119
2,829,707 A * 4/1958 Liebson ..... 297/411.42
3,001,822 A * 9/1961 Pagliaro et al. ..... 297/381
3,030,146 A * 4/1962 Faxon ..... 297/411.45
3,066,982 A * 12/1962 Brower ..... 297/440.15
3,104,913 A * 9/1963 Faulkner et al. ..... 297/218.3
3,183,036 A * 5/1965 Hill ..... 297/440.22
3,608,959 A * 9/1971 Sarvas ..... 297/218.3
4,035,020 A * 7/1977 Gold ..... 297/271.5
4,074,919 A * 2/1978 Watts ..... 297/233
4,077,517 A * 3/1978 Hilemn ..... 206/577
4,077,666 A * 3/1978 Heumann ..... 297/440.14
4,179,158 A * 12/1979 Flaum et al. ..... 297/440.17
4,301,985 A * 11/1981 Ballard ..... 248/188
4,437,704 A * 3/1984 Hovsepians ..... 297/440.17
4,602,817 A * 7/1986 Raftery ..... 297/440.1
5,080,438 A * 1/1992 Moyer ..... 297/440.23
5,601,340 A * 2/1997 Stout ..... 297/440.16
5,678,897 A * 10/1997 Prestia ..... 297/440.15
5,738,414 A * 4/1998 Wieland et al. ..... 297/440.1
5,890,767 A * 4/1999 Chang ..... 297/440.14
6,070,941 A * 6/2000 Chung ..... 297/440.16
6,296,314 B1 * 10/2001 Klein ..... 297/440.14
6,568,058 B1 * 5/2003 Wieland et al. ..... 29/91.1
6,669,401 B1 * 12/2003 Lin ..... 403/408.1
6,695,408 B1 * 2/2004 Nobbe ..... 297/440.11
6,839,950 B2 * 1/2005 Guillot ..... 29/428
6,942,298 B2 * 9/2005 Harrison ..... 297/440.1
7,300,111 B2 * 11/2007 Huang ..... 297/440.16
D567,456 S * 4/2008 Martin et al. ..... D30/118
7,387,344 B2 * 6/2008 Yu ..... 297/440.1

(Continued)

*Primary Examiner* — Laurie Cranmer
(74) *Attorney, Agent, or Firm* — Wolf, Greenfield & Sacks, P. C.; Charles R. Sutton

(57) ABSTRACT

This invention concerns a sofa which solves the problems of the prior art by providing a sofa that can easily be assembled or disassembled by the end consumer at home. The disassembled sofa can be stored in 3 flat boxes. Storage in the flat boxes not only helps the warehouse to store the sofa, but when the end user has purchased the sofa it is easier in such flat boxes to transport it to the location where it will be assembled. The way this invention accomplishes these results is as follows: The parts of the sofa can be broken down into three boxes. Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame.

12 Claims, 9 Drawing Sheets

U.S. PATENT DOCUMENTS 7,419,220 B2 * 9/2008 White et al. ..... 297/440.14
7,547,073 B2 * 6/2009 White et al. ..... 297/440.1
7,744,162 B2 * 6/2010 Griggs, Jr. ..... 297/440.14
2007/0007813 A1 * 1/2007 Pomeroy et al. ..... 297/440.1

* cited by examiner

SOFA KIT

CROSS REFERENCE TO RELATED APPLICATIONS

There are no related applications.

STATEMENT REGARDING FEDERALLY SPONSORED RESEARCH AND DEVELOPMENT

This invention was not made using federally sponsored research and development.

THE NAMES OF THE PARTIES TO A JOINT RESEARCH AGREEMENT

None.

REFERENCE TO A SEQUENCE LISTING

There is no sequence listing in this application.

BACKGROUND OF THE INVENTION

This invention relates to the field of furniture and more particularly to the packaging of sofa kits. Sofas have long been known in the furniture making arts but the traditional sofa design with a one piece frame is not susceptible to easy assembly and disassembly. It is also not easy to package such a sofa in a flat box for storage at the seller's warehouse.

BRIEF SUMMARY OF THE INVENTION

This invention concerns a sofa which solves the problems of the prior art by providing a sofa that can easily be assembled or disassembled by the end consumer at home. The disassembled sofa can be stored in a flat box. Storage in the flat box not only helps the warehouse to store the sofa, but when the end user has purchased the sofa it is easier in such a flat box to transport it to the location where it will be assembled. The way this invention accomplishes these results is as follows: The parts of the sofa can be broken down into three boxes. Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame.

DETAILED DESCRIPTION OF THE INVENTION

This invention concerns a sofa which solves the problems of the prior art by providing a sofa that can easily be assembled or disassembled by the end consumer at home. The disassembled sofa can be stored in a flat box. Storage in the flat box not only helps the warehouse to store the sofa, but when the end user has purchased the sofa it is easier in such a flat box to transport it to the location where it will be assembled. The way this invention accomplishes these results is as follows: The parts of the sofa can be broken down into three boxes. Chaise sections can be assembled by placing the seat back flat on the ground and placing the seat frame/arm upright on top of the seat back. A metal threaded rod is used to connect the seat frame and the seat back. A metal nut is used to secure the seat frame to the back using a wrench that comes provided in the package of the kit. The legs are then twisted onto the bottom of the seat frame.

Figure 1:
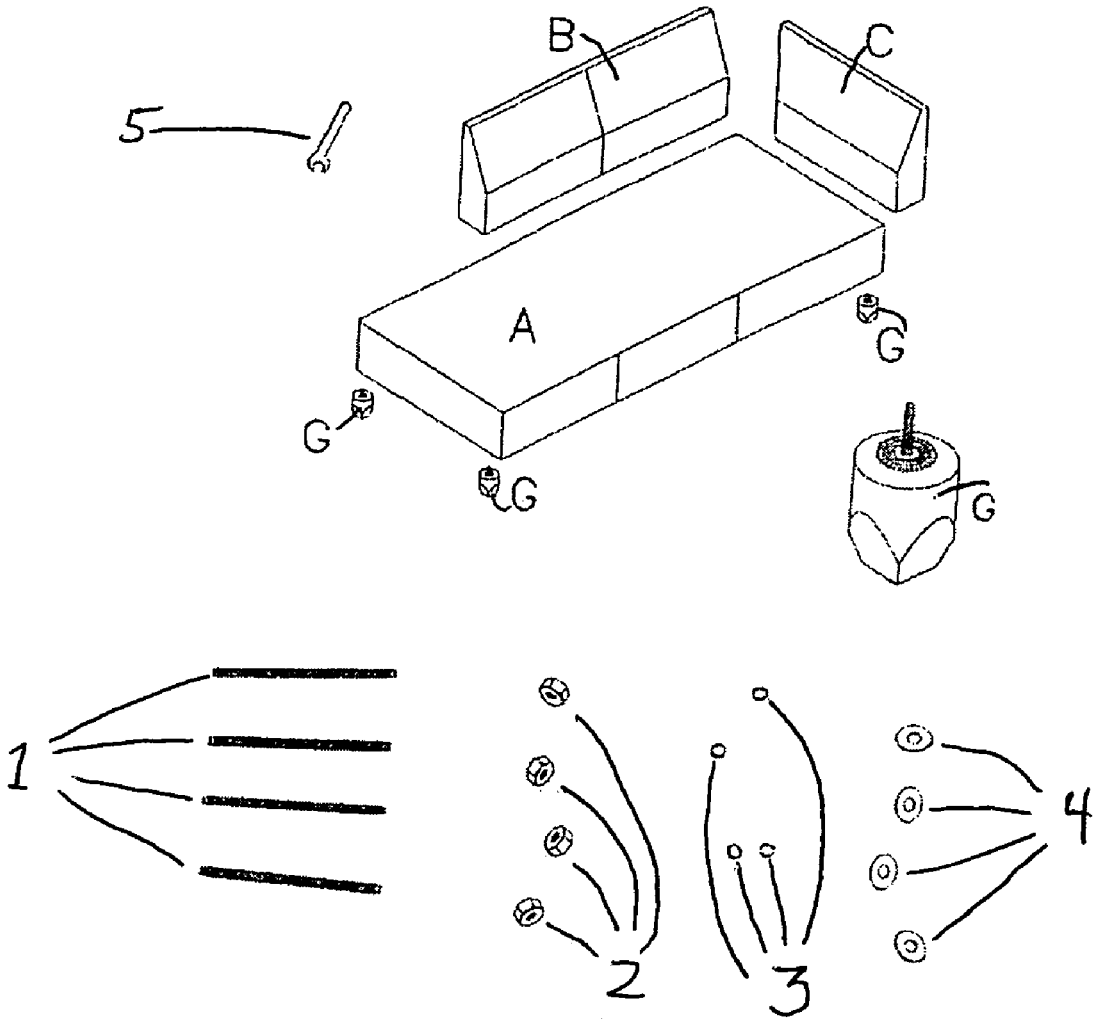
FIG. 1 is a fully exploded diagram of the first portion of the kit.
Figure 2:
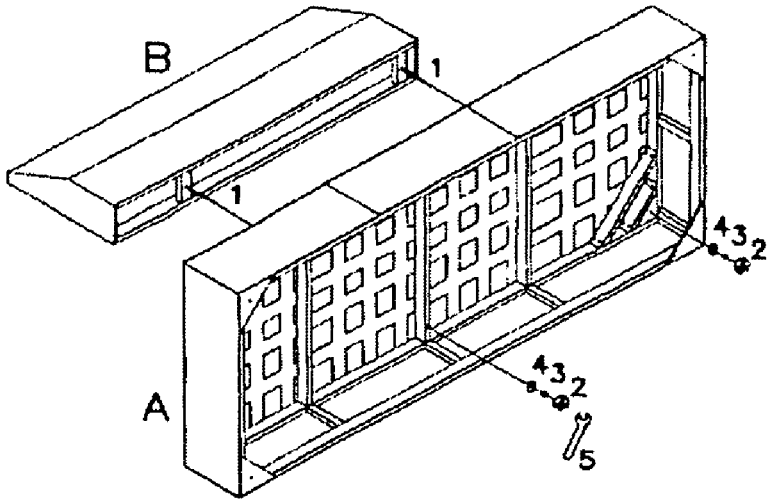
FIG. 2 shows the first step in the assembly of the first portion.
Figure 3:
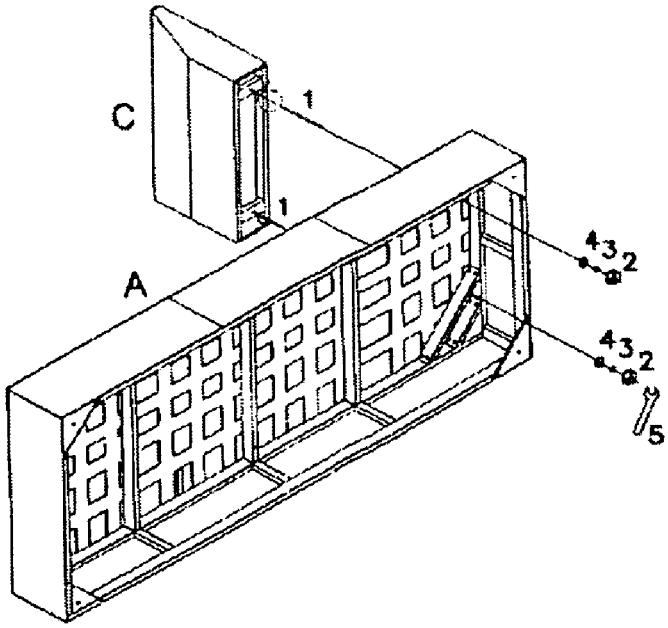
FIG. 3 shows the second step in the assembly of the first portion.
Figure 4:
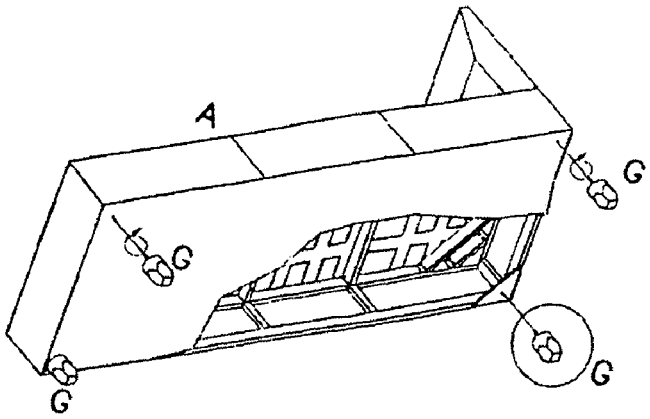
FIG. 4 shows the third step in the assembly of the first portion.
Figure 5:
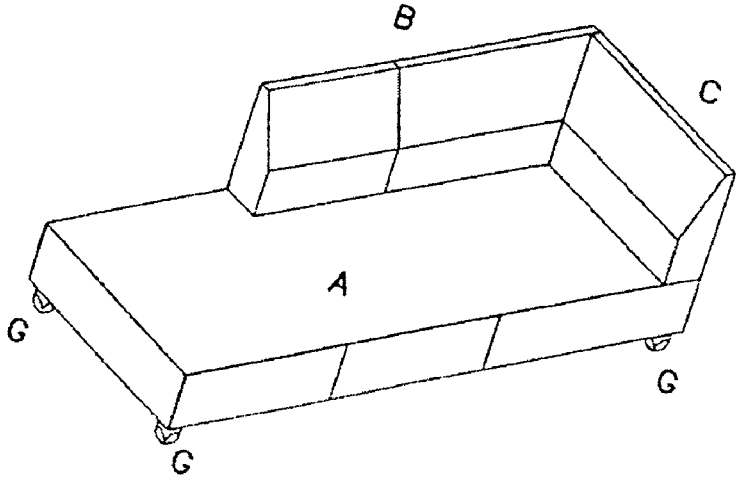
FIG. 5 shows the fourth step in the assembly of the first portion.
Figure 6:
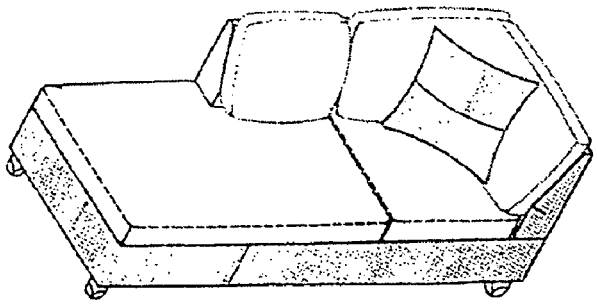
FIG. 6 shows the final step in the assembly of the first portion.
Figure 7:
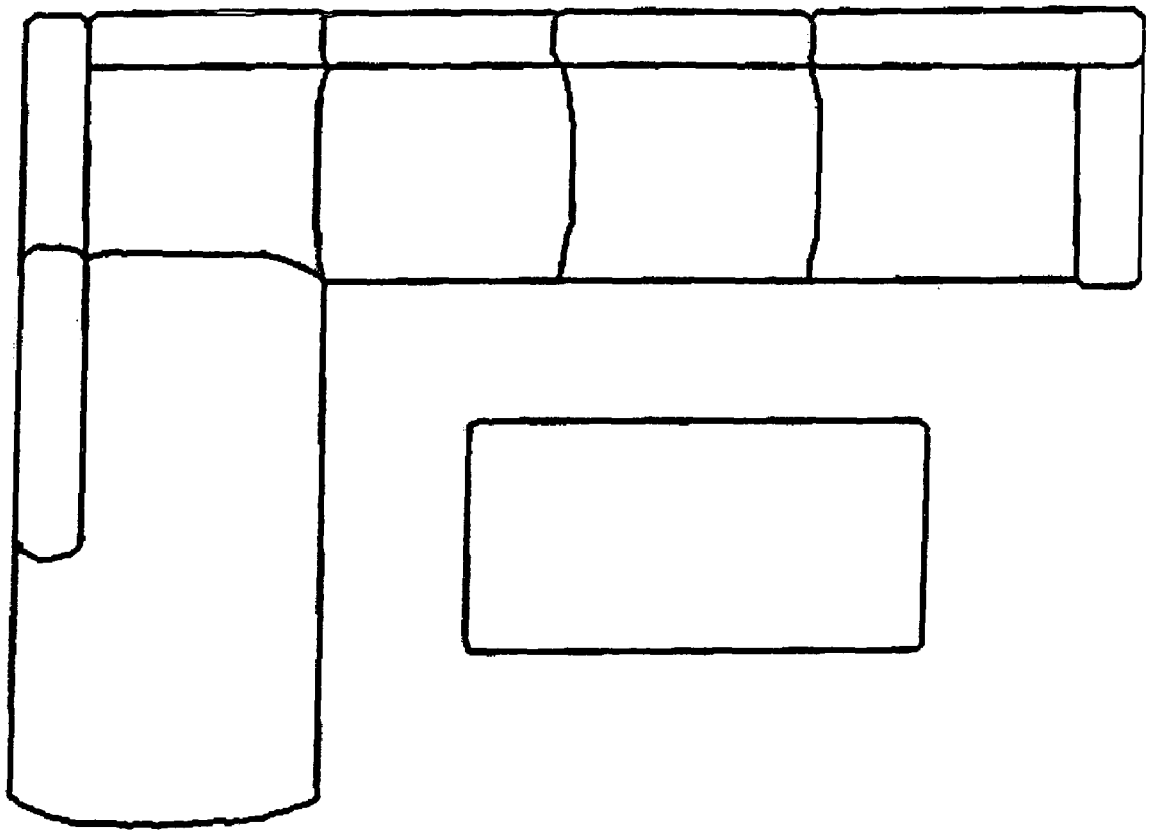
FIG. 7 shows a floor plan of how the three portions are situated in a room.

Turning now to FIG. 1, the parts found in the first box are shown disassembled. The first box contains four metal threaded rods (1), four nuts (2), four lock washers (3), four washers (4), a wrench (5), four feet (G) (of which one is shown over-sized in FIG. 1 so detail can be seen), a first portion base (A), a first portion main back (B), and a first portion secondary back (C). Turning now to FIG. 2, two of the metal threaded rods (1) are being used to attach the first portion main back (B) to the first portion base (A) by connecting to each of the metal threaded rods (1) on the far side of the first portion base (A) in the following order: a washer (4), a lock washer (3), and a nut (2) using the wrench (5). Turning now to FIG. 3, two of the metal threaded rods (1) are being used to attach the first portion secondary back (C) to the first portion base (A) by connecting to each of the metal threaded rods (1) on the far side of the first portion base (A) in the following order: a washer (4), a lock washer (3), and a nut (2) using the wrench (5). Turning now to FIG. 4, the feet (G) are screwed into the four bottom corners of the first portion base (A). FIG. 5 shows the first portion after assembly and FIG. 6 shows the assembled first portion after cushions are added. The wrench (5) may be omitted from this box if it is contained in the second box. The first portion, the second portion and the third portion will eventually be arranged in the pattern seen from above at FIG. 7, showing the arrangement of a chaise lounge, a sofa and an ottoman.

Figure 8:
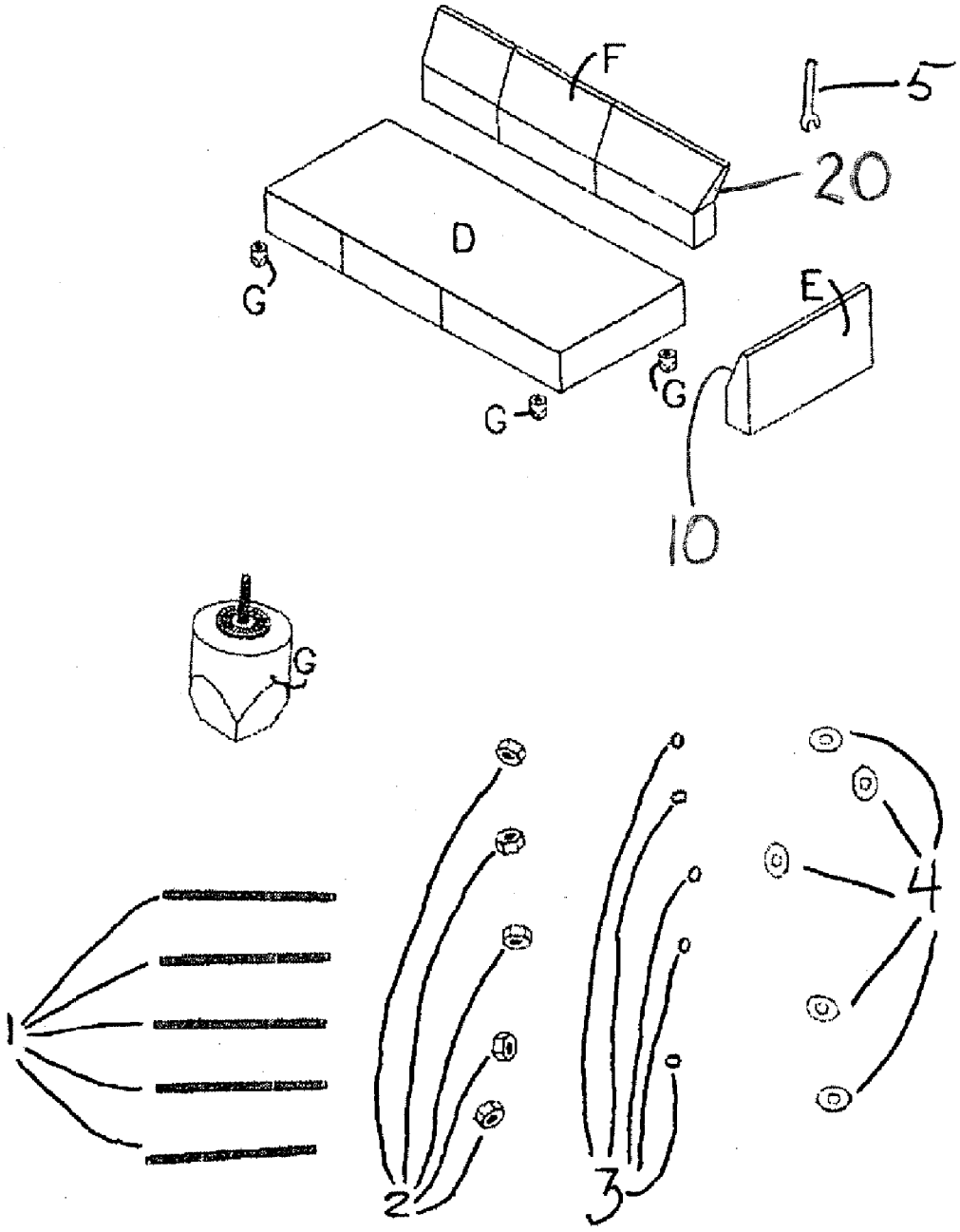
FIG. 8 shows a fully exploded diagram of the parts of the second portion of the sofa kit.
Figure 9:
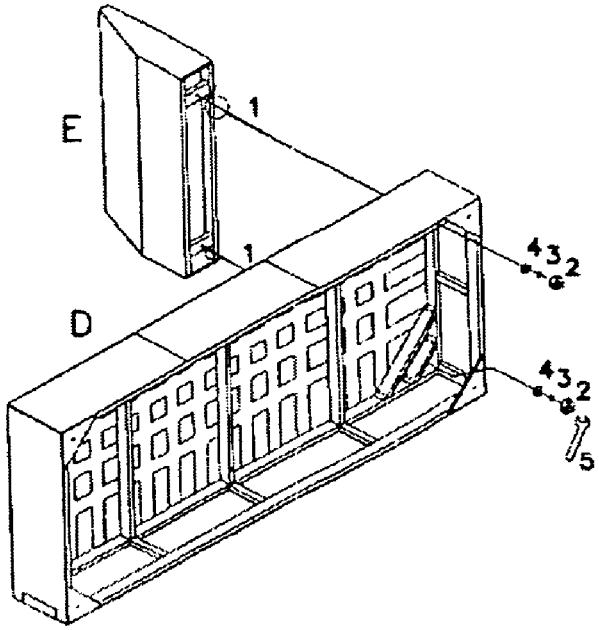
FIG. 9 shows the first assembly step of the second portion.
Figure 10:
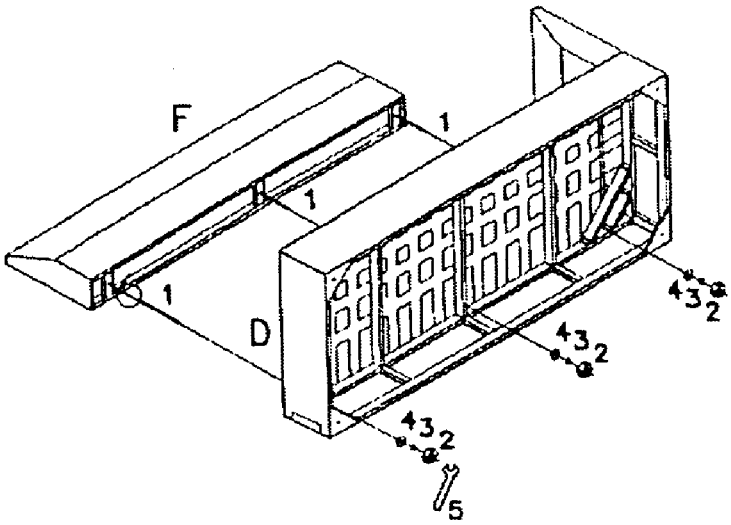
FIG. 10 shows the second assembly step of the second portion.
Figure 11:
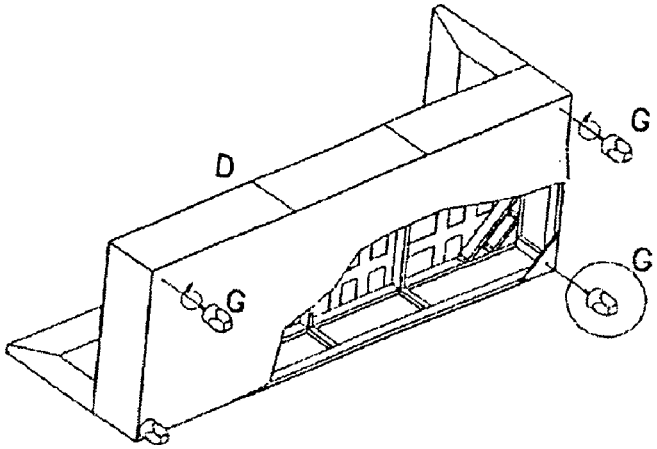
FIG. 11 shows the third assembly step of the second portion.
Figure 12:
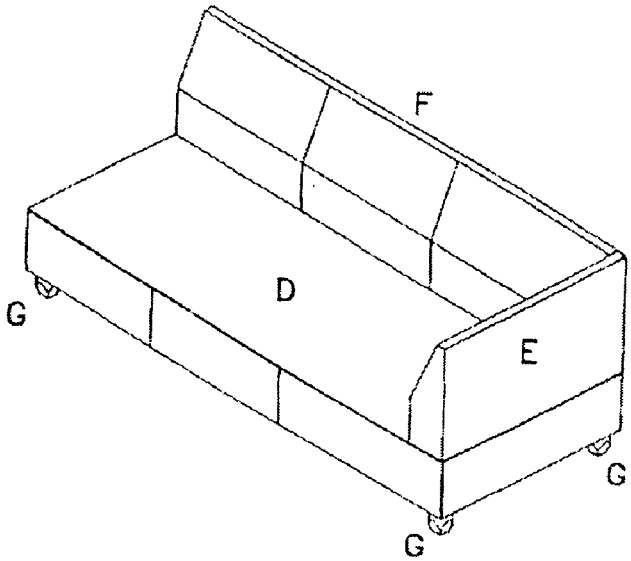
FIG. 12 shows the fourth assembly step of the second portion.
Figure 13:
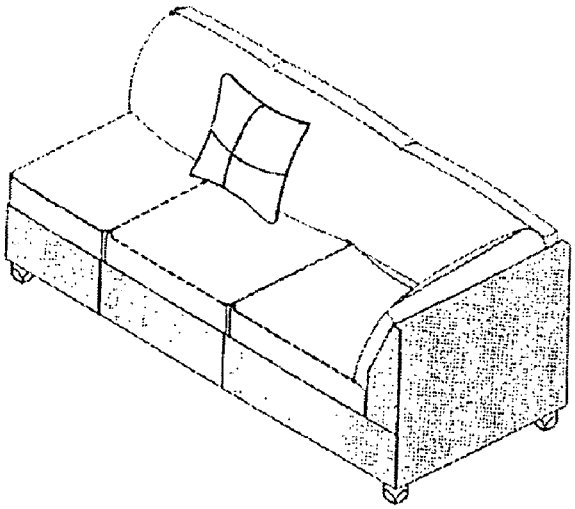
FIG. 13 shows the fifth assembly step of the second portion.

Turning now to FIG. 8, the parts found in the second box are shown disassembled. The second box contains five metal threaded rods (1), five nuts (2), five lock washers (3), five washers (4), a wrench (5), four feet (G) (of which one is shown over-sized in FIG. 8 so detail can be seen), a second portion base (D), a second portion main back (F) with a first beveled surface 20, and a second portion secondary back (E) with a second beveled surface 10, which together form a mitered joint. Turning now to FIG. 9, two of the metal threaded rods (1) are being used to attach the second portion secondary back (E) to the second portion base (D) by connecting to each of the metal threaded rods (1) on the far side of the second portion base (D) in the following order: a washer (4), a lock washer (3), and a nut (2) using the wrench (5). Turning now to FIG. 10, three of the metal threaded rods (1) are being used to attach the second portion main back (F) to the second portion base (D) by connecting to each of the metal threaded rods (1) on the far side of the second portion base (D) in the following order: a washer (4), a lock washer (3), and a nut (2) using the wrench (5). Turning now to FIG. 11, feet (G) are being screwed into the four bottom corners of the second portion base (D). FIG. 12 shows the second portion assembled and FIG. 13 shows the second portion after cushions have been added. The wrench (5) may be omitted from the second box if it is contained in the first box.

Figure 14:
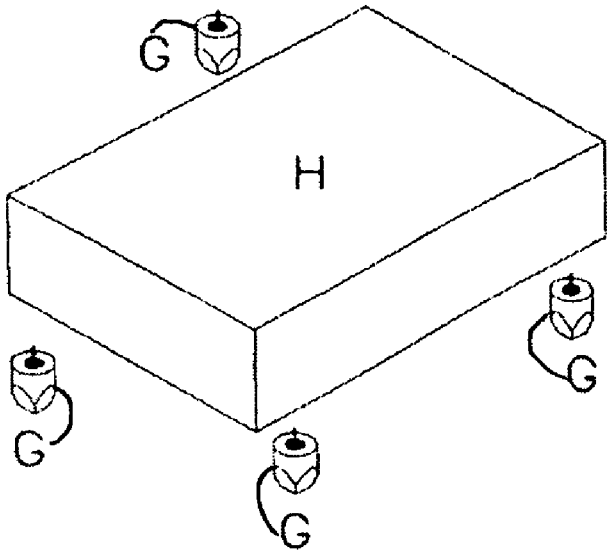
FIG. 14 shows a fully exploded diagram of the third portion of the sofa kit.
Figure 15:
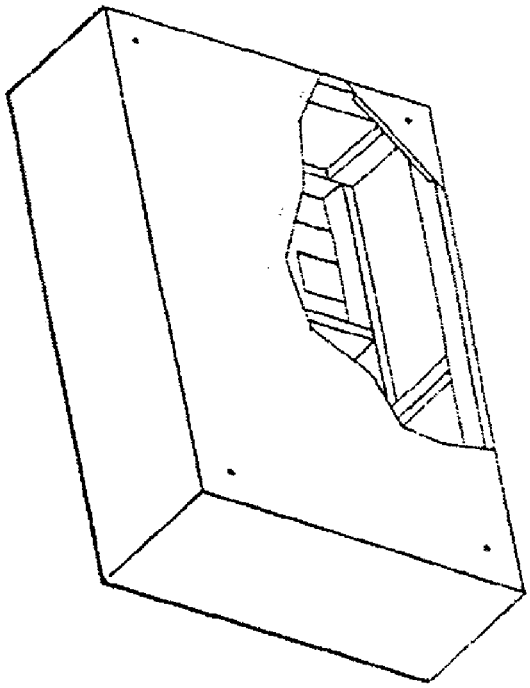
FIG. 15 shows a cutaway view of the interior of the ottoman.
Figure 16:
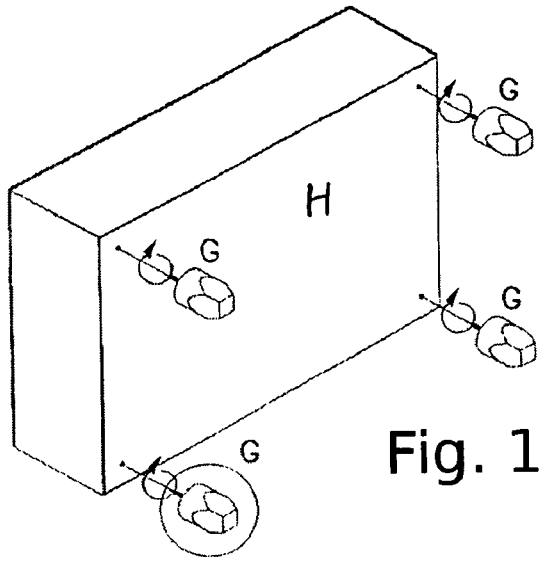
FIG. 16 shows the first step of the assembly of the third portion.
Figure 17:
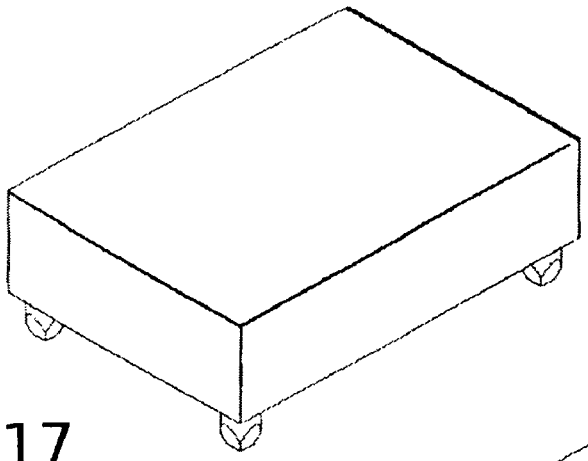
FIG. 17 shows the third portion with the legs attached.
Figure 18:
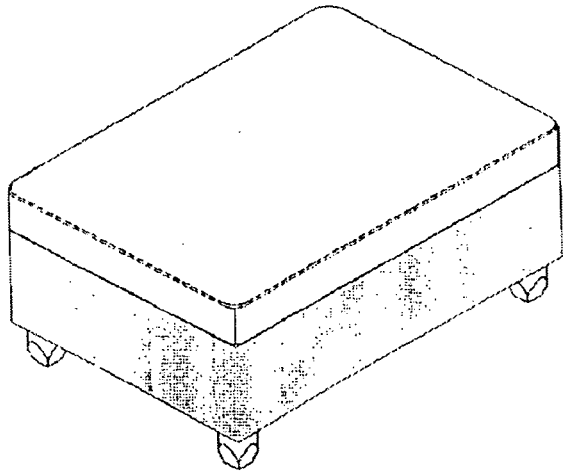
FIG. 18 shows the final step of assembling the third portion.

Turning now to FIG. 14, the third portion is shown in a fully exploded diagram to have a third portion base (H), and four feet (G). FIG. 15 is a cutaway view showing the frame of wood or other suitable substance that the fabric or other upholstery is mounted on. Turning now to FIG. 16, the feet (G) are being screwed onto the four bottom corners of the third portion base (H). FIG. 17 shows the third portion assembled and FIG. 18 shows the third portion after a cushion has been added. The third portion is of course shipped, stored, and sold in the third box.

The parts of this sofa kit can thus be fit into three boxes for easy shipping, storage, and sale and yet they can easily be assembled at home by the end user. The attachment means shown on the feet (G) in the drawing sheets comprises a threaded metal cylindrical extension which can be screwed into a corresponding hole on a furniture base, but several other attachment means for feet are well known in the furniture arts. Applicant does not intend to be limited to this one attachment means.

I claim:

1. A sofa kit comprising:

a sofa base, the sofa base having a substantially planar top surface and a first corner;

a substantially linear first sofa back, the first sofa back having a bottom portion configured to abut the top surface of the sofa base;

a substantially linear second sofa back, the second sofa back having a bottom portion, wherein a length of the second sofa back is smaller than a length of the first sofa back;

a plurality of fasteners constructed and arranged to be removably securable to the bottom portion of the first sofa back and the second sofa back to removably couple the bottom portion of the first sofa back and the second sofa back to the top surface of the sofa base;

wherein the first and second sofa backs are configured to be secured to the sofa base such that the second sofa back is substantially perpendicular to the first sofa back and a first end of the first sofa back is positioned at the first corner of the sofa base;

wherein the second sofa back is configured to be secured to the sofa base such that a first end of the second sofa back is offset from the first corner of the sofa base, and wherein at least one of a first end of the first sofa back and a first end of the second sofa back is beveled such that together the first end of the first sofa back and the first end of the second sofa back form a mitered joint at the first corner of the sofa base.

2. The sofa kit of claim 1, wherein at least one of the first sofa back and the second sofa back is beveled substantially across its length.

3. The sofa kit of claim 1, wherein both the first end of the first sofa back and the first end of the second sofa back are beveled.

4. The sofa kit of claim 3, wherein both the first sofa back and the second sofa back are beveled substantially across their lengths.

5. The sofa kit of claim 1, wherein the plurality of fasteners are a plurality of threaded rods.

6. The sofa kit of claim 1, wherein the first sofa back has a first height and the second sofa back has a second height, wherein the first height is substantially the same as the second height.

7. A sofa kit comprising:

a sofa base, the sofa base having a substantially planar top surface and a first corner;

a substantially linear first sofa back, the first sofa back having a bottom portion configured to abut the top surface of the sofa base;

a substantially linear second sofa back, the second sofa back having a bottom portion;

wherein the first sofa back has a first height and the second sofa back has a second height, wherein the first height is substantially the same as the second height;

a plurality of fasteners configured to removably secure the bottom portion of the first sofa back and the second sofa back to the top surface of the sofa base, wherein the plurality of fasteners are a plurality of threaded rods;

wherein the first and second sofa backs are configured to be secured to the sofa base such that the second sofa back is substantially perpendicular to the first sofa back, wherein the first and second sofa backs each include an upper portion and a lower portion; and wherein at least the upper portion of the first sofa back includes a first beveled surface, and at least the upper portion of the second sofa back includes a second beveled surface such that together at least the upper portion of the first sofa back and at least the upper portion of the second sofa back form a mitered joint at the first corner of the sofa base.

8. The sofa kit of claim 7, wherein at least one of the first sofa back and the second sofa back is beveled substantially across its length.

9. The sofa kit of claim 7, wherein both the first sofa back and the second sofa back are beveled substantially across their lengths.

10. The sofa kit of claim 7, wherein a length of the second sofa back is smaller than a length of the first sofa back.

11. The sofa kit of claim 7, wherein the lower portion of the first sofa back is not beveled.

12. The sofa kit of claim 11, wherein the lower portion of the second sofa back is not beveled.

* * * * *